US012788088B2

(12) United States Patent
Fitzgerald et al.

(10) Patent No.: US 12,788,088 B2
(45) Date of Patent: Nov. 10, 2026

(54) UTILITY CLIP POCKET

(71) Applicant: 5.11, Inc., Manteca, CA (US)

(72) Inventors: Christina Marie Fitzgerald, Dana Point, CA (US); Matthew David Noble, Long Beach, CA (US); Camille Marie Machado, San Clemente, CA (US)

(73) Assignee: 5.11, Inc., Manteca, CA (US)

( * ) Notice: Subject to any disclaimer, the term of this patent is extended or adjusted under 35 U.S.C. 154(b) by 133 days.

(21) Appl. No.: 18/500,819

(22) Filed: Nov. 2, 2023

(65) Prior Publication Data

US 2024/0148088 A1 May 9, 2024

Related U.S. Application Data

(60) Provisional application No. 63/382,462, filed on Nov. 4, 2022.

(51) Int. Cl.

| | |
|---|---|
| ***A41D 27/00*** | (2006.01) |
| ***A41D 27/20*** | (2006.01) |
| ***A45F 5/02*** | (2006.01) |

(52) U.S. Cl.

CPC ..... *A41D 27/20* (2013.01); *A45F 5/022* (2013.01)

(58) Field of Classification Search

CPC ..... A41D 27/20; A41D 27/08; A41D 27/22

See application file for complete search history.

(56) References Cited

U.S. PATENT DOCUMENTS 530,542 A * 12/1894 Mahon ..... A41D 27/20 2/250
1,039,040 A * 9/1912 Elder ..... A45F 5/02 24/576.1
1,059,130 A * 4/1913 Elder ..... A45F 5/02 24/3.6
1,154,258 A * 9/1915 Lewis ..... A41D 27/20 2/253
1,161,435 A * 11/1915 Baker ..... A41D 27/20 2/253
1,212,639 A * 1/1917 Hester ..... A41D 27/20 2/253

(Continued)

OTHER PUBLICATIONS

Wrangler® Riggs Workwear® Long Sleeve Button Down Solid Twill Work Shirt, https://www.wrangler.com/shop/wrangler-riggs-workwear-long-sleeve-button-down-solid-twill-work-shirt-3W501.html retrieved on May 13, 2024.

(Continued)

*Primary Examiner* — Richale L Quinn
(74) *Attorney, Agent, or Firm* — VIA LLP

(57) ABSTRACT

A utility pocket clip may include an inner garment layer. A utility pocket clip may include an outer garment layer connected to the inner garment layer and cooperating to form at least a portion of a pocket. An utility pocket clip may include a loop located within the pocket, the loop comprising, a material strap having a first side and a second side, wherein the first side comprises a first connection and the second side comprises a second connection, where in the first connection and the second connection are secured within the pocket, wherein the loop is spaced a first distance from a first side of the pocket, a second distance from a top of the pocket, and a third distance from a bottom of the pocket.

24 Claims, 7 Drawing Sheets

(56) References Cited

U.S. PATENT DOCUMENTS 1,273,419 A * 7/1918 Stewart ..... A41D 27/20 2/249
1,603,044 A 10/1926 Gise
1,692,200 A * 11/1928 Capuano ..... A44C 19/00 2/249
1,764,483 A * 6/1930 Watkins ..... A41D 13/0012 2/247
1,780,356 A * 11/1930 Liberman ..... A41D 27/20 2/248
1,806,797 A * 5/1931 Guiterman ..... A41D 27/20 2/250
2,019,993 A 11/1935 Regal
2,097,975 A * 11/1937 Habegger ..... A41D 27/20 D3/226
2,312,177 A * 2/1943 Lester ..... A41D 27/20 D2/857
2,642,576 A * 6/1953 Kotkes ..... A41D 13/0012 2/253
2,883,673 A * 4/1959 Solomon ..... A41D 27/207 2/253
3,320,620 A * 5/1967 Weidler ..... A63B 47/001 224/919
3,968,522 A 7/1976 Riess
4,069,954 A 1/1978 Rauch
4,168,544 A 9/1979 Kallman
4,334,326 A * 6/1982 Mallow ..... A44B 15/00 2/249
4,637,075 A * 1/1987 Ingrisano ..... A61F 17/00 2/253
4,791,681 A * 12/1988 Dean ..... A41D 13/012 2/253
4,860,388 A * 8/1989 Dean ..... A41D 13/012 2/106
4,966,320 A * 10/1990 DeSantis ..... F41C 33/0209 224/931
5,072,456 A * 12/1991 Elin ..... A41D 13/0012 2/253
5,154,506 A 10/1992 Leard
5,170,919 A * 12/1992 DeSantis ..... F41C 33/048 224/931
5,247,707 A * 9/1993 Parker ..... A41D 13/0012 2/108
5,509,147 A * 4/1996 Busquets ..... A41D 27/202 2/253
5,517,696 A * 5/1996 Krugler ..... A41D 27/20 2/919
5,584,074 A * 12/1996 Battle-Smith ..... A45F 5/02 2/113
5,652,961 A * 8/1997 Knight-Yurt ..... A41D 13/12 2/114
5,752,633 A 5/1998 Antaki
5,775,398 A * 7/1998 Siegel ..... A45C 11/182 150/147
5,884,338 A * 3/1999 Golde ..... A41D 27/20 224/660
5,903,928 A * 5/1999 Hyung-Seob ..... A41D 27/00 2/244
5,909,834 A * 6/1999 Parrott, III ..... F41C 33/048 224/660
6,099,382 A * 8/2000 Wilson ..... A41C 3/0057 2/247
6,102,201 A * 8/2000 Marston ..... A45F 5/021 224/919
6,108,819 A * 8/2000 DeBaene ..... A41D 1/067 2/237
6,131,198 A * 10/2000 Westrick ..... F41C 33/048 2/2.5
6,460,198 B1 * 10/2002 Dilworth, Jr. ..... A62B 17/006 2/457
6,543,063 B2 * 4/2003 Greer ..... A41B 11/00 2/409
6,659,321 B2 * 12/2003 Hartranft ..... A45F 5/022 224/230
7,058,987 B2 * 6/2006 Salazar ..... A41D 1/06 2/247
8,032,951 B1 * 10/2011 Nestberg ..... A41D 27/20 2/69
8,316,469 B2 * 11/2012 Miller ..... A41D 13/0012 2/247
8,328,058 B2 * 12/2012 Wilson ..... A45F 3/005 224/675
8,402,562 B1 * 3/2013 Seddiki ..... A41D 27/205 2/247
8,522,367 B2 * 9/2013 French ..... F41C 33/0209 2/250
8,719,966 B2 * 5/2014 Grozdev ..... A41D 27/20 2/247
9,149,079 B1 * 10/2015 Burke ..... A41D 27/20
9,414,631 B2 * 8/2016 Schrimpf ..... A41D 27/205
9,445,637 B2 * 9/2016 Buczkowski ..... A41D 27/205
9,557,139 B1 * 1/2017 Miner ..... A44B 18/0073
9,931,545 B1 4/2018 Calcaterra
10,018,448 B2 * 7/2018 Klymenko ..... F41C 33/048
10,383,428 B2 * 8/2019 Alexis ..... A41B 1/18
10,582,758 B1 * 3/2020 DeMeo ..... A41F 1/02
11,304,466 B1 * 4/2022 Tellish ..... A45F 5/1575
12,171,283 B2 * 12/2024 Peterson ..... A41D 13/0012
12,295,437 B2 * 5/2025 Moss ..... A41D 27/20
2001/0027834 A1 * 10/2001 Southwick ..... A45F 5/00 150/108
2003/0131401 A1 * 7/2003 Dilworth, Jr. ..... A41D 13/12 2/457
2005/0022289 A1 * 2/2005 Platt ..... A41D 13/0012 2/250
2005/0040194 A1 2/2005 Frye et al.
2006/0169731 A1 * 8/2006 Matulewic ..... A45F 5/021 224/684
2007/0083984 A1 * 4/2007 Wagenknecht ..... A41D 1/08 2/227
2009/0230001 A1 * 9/2009 George ..... A45C 7/0063 224/230
2009/0282600 A1 * 11/2009 Robinson ..... A41D 27/20 2/247
2010/0175168 A1 * 7/2010 Yari ..... A41D 1/06 2/244
2011/0072556 A1 * 3/2011 Bang ..... A41D 27/08 2/247
2011/0214214 A1 * 9/2011 Seguin ..... A41D 13/0012 2/253
2012/0093442 A1 * 4/2012 Lett ..... A45C 3/001 112/475.08
2013/0025019 A1 1/2013 Jones
2013/0219581 A1 * 8/2013 Schrimpf ..... A41D 27/205 2/69
2014/0215763 A1 8/2014 White
2015/0007375 A1 * 1/2015 Lee-Holowka ..... A41D 27/22 2/69
2015/0089708 A1 * 4/2015 Trevino ..... A41D 13/0012 2/69
2015/0144673 A1 * 5/2015 Dahl ..... F41C 33/00 224/587
2015/0201761 A1 * 7/2015 Wollenberg ..... A45F 4/02 224/160
2015/0282535 A1 * 10/2015 Rowe ..... A41D 1/067 2/237
2015/0374048 A1 * 12/2015 Theodossiou ..... A41D 13/1245 2/114
2016/0286947 A1 * 10/2016 Shotey ..... A41D 1/06
2017/0112210 A1 * 4/2017 McVarish ..... A41D 27/20
2018/0064236 A1 * 3/2018 Wolfe ..... A41B 1/08
2019/0239610 A1 * 8/2019 Kannally ..... A45F 5/022
2019/0316875 A1 * 10/2019 Schmadeka ..... F41C 33/0218
2020/0348107 A1 * 11/2020 McFadden ..... F41C 33/0227
2020/0359722 A1 * 11/2020 Cleghorn ..... A41D 1/06
2021/0267291 A1 * 9/2021 Mayer ..... A41D 27/201

(56) References Cited

U.S. PATENT DOCUMENTS

| | | | | |
|---|---|---|---|---|
| 2022/0142277 | A1* | 5/2022 | Michaeloff | A41D 1/06 |
| 2023/0189909 | A1* | 6/2023 | Moss | A41D 27/20 2/250 |
| 2023/0404182 | A1* | 12/2023 | Dammaschke | A41D 1/04 |

OTHER PUBLICATIONS

Photographs of Wrangler® Riggs Workwear® Shirt Hidden Utility Loop (Apr. 2024) (2 pages).

* cited by examiner

UTILITY CLIP POCKET

INCORPORATION BY REFERENCE TO ANY PRIORITY APPLICATIONS

This application claims priority under 35 U.S.C. § 119(e) to U.S. Provisional Patent Application No. 63/382,462, entitled "UTILITY CLIP POCKET" and filed on Nov. 4, 2022, the entire disclosure of which is hereby incorporated by reference herein.

BACKGROUND OF THE INVENTION

Field

The present disclosure generally relates to a utility clip on a garment or other item. In particular, the present disclosure relates to a utility clip within a pocket.

Description of Related Art

Existing pockets are capable of holding items and existing utility clips are capable of securing items. However, a need exists for an improved pocket, which address one or more shortcomings of the prior art and/or provide the public with a useful choice.

SUMMARY OF THE INVENTION

In some aspects, the disclosure involves a utility clip pocket, including: an inner garment layer; an outer garment layer connected to the inner garment layer and cooperating to form at least a portion of a pocket; a loop located within the pocket, the loop including; a material strap having a first side and a second side; wherein the first side includes a first connection and the second side includes a second connection; where in the first connection and the second connection are secured within the pocket; wherein the loop is spaced a first distance from a first side of the pocket, a second distance from a top of the pocket, and a third distance from a bottom of the pocket.

In some aspects, the first distance and the second distance are between 1 and 4 inches.

In some aspects, the first distance and the second distance is at least 1 inch.

In some aspects, a distance between the first side and the second side of the material strap is less than a distance from the first side of the pocket to a second side of the pocket.

In some aspects, the loop is configured to engage a clip of a knife.

In some aspects, the material strap is between 0.5 and 2 inches wide.

In some aspects, a coin pocket located within the pocket.

In some aspects, the first side and the second side of the material strap are secured to the coin pocket.

In some aspects, a secondary overlapping material is located within the pocket and connected to the outer garment layer, wherein the secondary overlapping material cooperates with the outer garment layer to form a secondary pocket within the pocket.

In some aspects, the secondary overlapping pocket is positioned adjacent to the loop and configured to hide an object within the loop when the secondary pocket is full.

In some aspects, the loop is spaced a fourth distance from a second side of the pocket.

In some aspects, the disclosure involves a garment including: A utility clip pocket, the utility clip pocket including; an outer garment layer; an inner garment layer having a first side, a second side, and a bottom side, a first side connection wherein the first side is connected to outer garment layer; a second side connection wherein the second side is connected to the outer garment layer; a bottom side connection wherein the bottom side is connected to the outer garment layer; wherein the outer garment layer, the inner garment layer, the first side connection, the second side connection, and the bottom side connection cooperate to form at least a portion of a pocket; a loop located within the pocket, the loop including; a material strap having a first strap side and a second strap side; wherein the first strap side includes a first connection and the second strap side includes a second connection; where in the first connection and the second connection are secured to the garment; wherein the loop is spaced a first distance from a first side connection, a second distance from a top of the pocket, and a third distance from a bottom side connection of the pocket.

In some aspects, a distance between the first strap side and the second strap side is less than a distance from the first side connection to the second side connection.

In some aspects, the loop is configured to engage a clip of a knife.

In some aspects, the material strap is between 0.5 and 2 inches wide.

In some aspects, a coin pocket is located within the pocket.

In some aspects, the first distance and the second distance are between 1 and 4 inches.

In some aspects, the first distance and the second distance is at least 1 inch.

In some aspects, a secondary overlapping material is located within the pocket and connected to the inner garment layer, wherein the secondary overlapping material cooperates with the inner garment layer to form a secondary pocket.

In some aspects, the secondary pocket is positioned adjacent to the loop and configured to hide an item within the loop when the secondary pocket is full.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Tactical or other garment or apparel with a pocket includes a utility clip loop within the pocket. The loop is configured to allow the clip of a knife, flashlight, pen, or other small item to pass through the loop to secure the item in a fixed location within the pocket. The garment or apparel can be a pair of pants, a skirt, or shorts. In other configurations, the garment or apparel can be a shirt, dress, skort, legging, jacket, vest, sweatshirt, coat, or any other type of garment. In some configurations, the utility clip loop can be employed in a non-apparel item, such as a bag, pack, or pouch, for example and without limitation.

In some configurations, the loop is made of nylon fabric, in this case nylon 6 fabric, for durability. The loop may also be made of the same material as the utility clip pocket 10 or any component of the utility clip pocket. As such the loop may be made of canvas, cloth, denim, or any other clothing material. The configuration of the loop provides a convenient anchor for clips on knives, small flashlights, etc. allowing the item to be secured to the inside of the pocket. Such an arrangement allows for secured concealment and easy/quick access to the item held by the loop.

Figure 1:
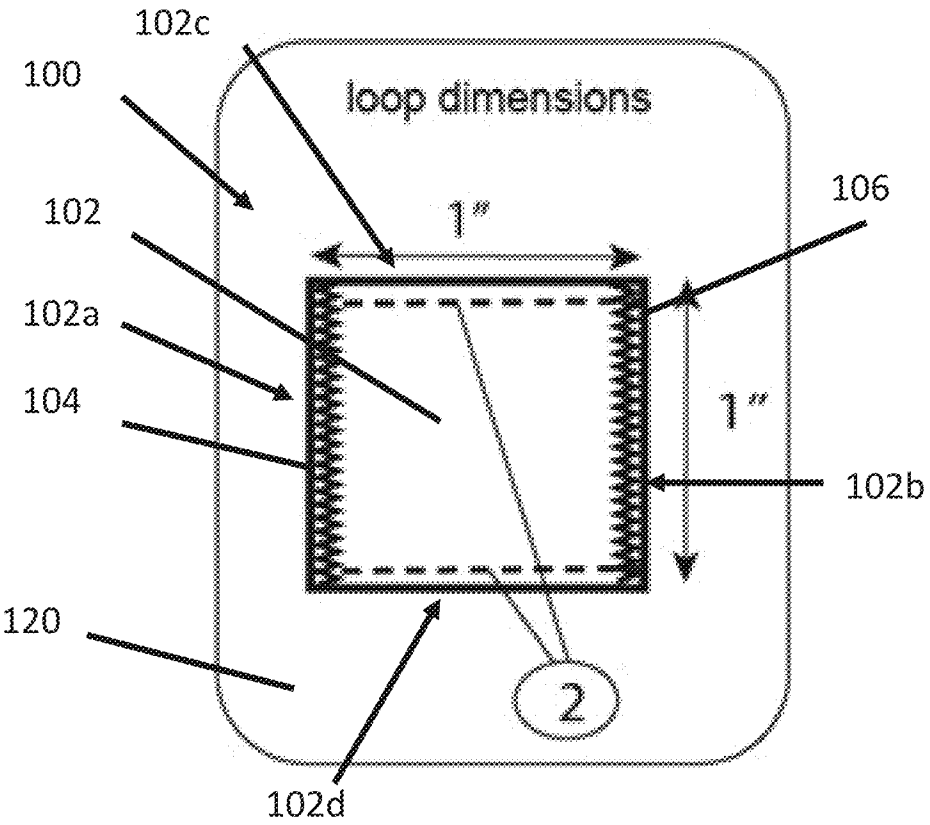
FIG. 1 is a front view of the loop of the utility clip pocket.

FIG. 1 shows an embodiment of the loop 100 of the utility clip pocket 10. With additional reference to FIGS. 2 and 3, the utility clip pocket 10 comprises a relatively inner garment layer 120 ("garment layer 120") and a relatively outer garment layer 130 cooperating to form and define an interior space 220 (see FIG. 4F) of the pocket 10. The loop 100 may comprise a material strap 102 having a first side edge 102*a*, a second side edge 102*b*, a top edge 102*c*, and a bottom edge 102*d*. A first connection 104 is located on a first side (e.g., the first side edge 102*a*) of the material strap 102 and a second connection 106 is located on a second side (e.g., the second side edge 102*b*) of the material strap 102. The first connection 104 and the second connection 106 may secure the strap 102 to the garment layer 120 via a stitched connection using thread. The loop 100 may have a width of approximately 1 inch. The width may be defined by the length of the strap 102, the distance between the first side edge 102*a* and the second side edge 102*b*, or the first connection 104 and the second connection 106. The width may be between 1 and 2 inches, 0.5 and 1.5 inches, 0.5 and 2 inches, or between 0.25 and 3 inches. Preferably, the width of the loop 100 is less than a width of the pocket 10. Preferably, the width of the loop 100 is a fraction of the width of the pocket 10, such as between about 5% to about 25%, about 5% to about 15%, or about 5% to about 10% of the width of the pocket 10. Such an arrangement can allow the object held by the loop 100 to be held at a particular, consistent location within the pocket 10 for quick access to the object by the user. The loop 100 may have a height of approximately 1 inch. The height of the loop 100 may be between 1 and 2 inches, 0.5 and 1.5 inches, 0.5 and 2 inches, or between 0.25 and 3 inches.

Figure 2:
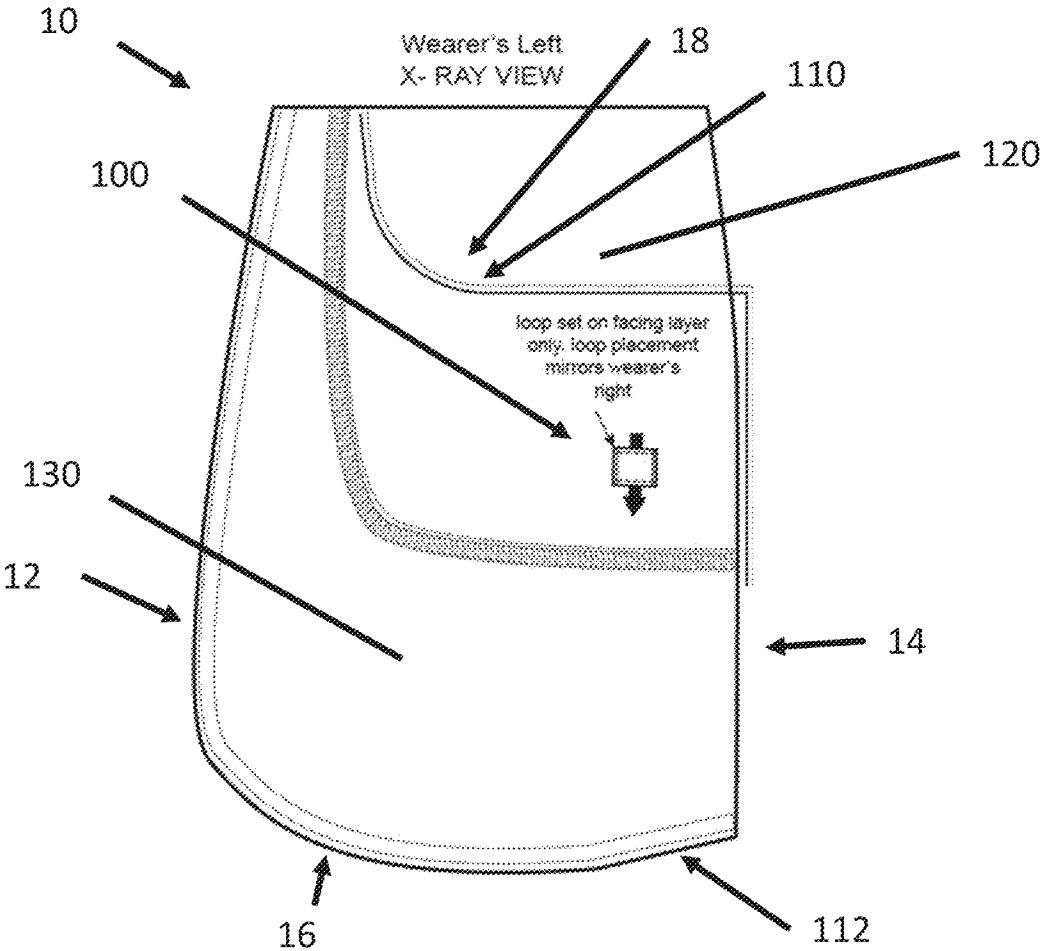
FIG. 2 is a semitransparent view of the wearer's left utility clip pocket.
Figure 3:
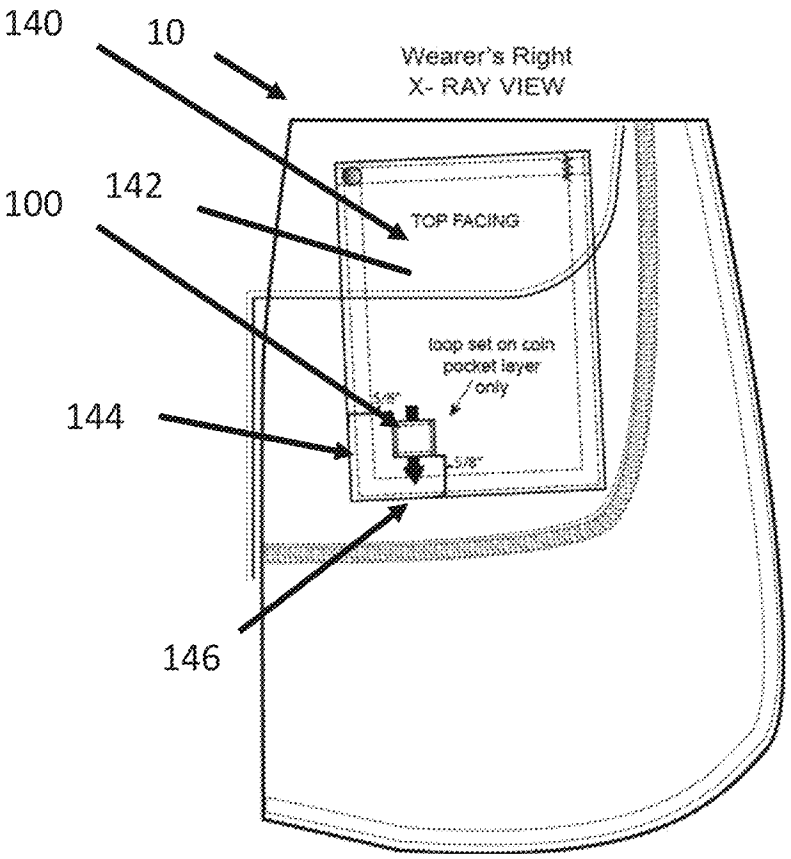
FIG. 3 is a semitransparent view of the wearer's right utility clip pocket.
Figure 4A:
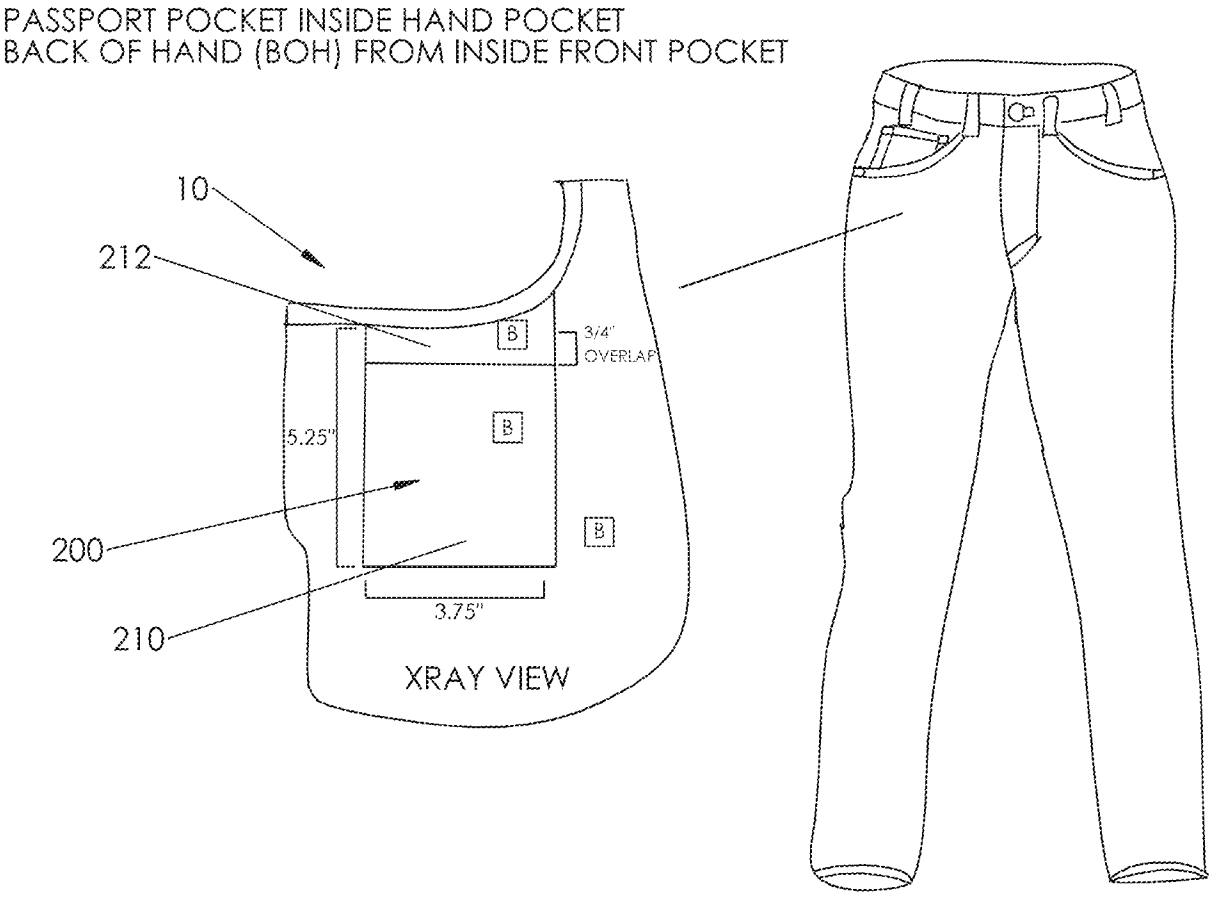
FIG. 4A is a view of the utility clip pocket with a secondary pocket.
Figure 4C:
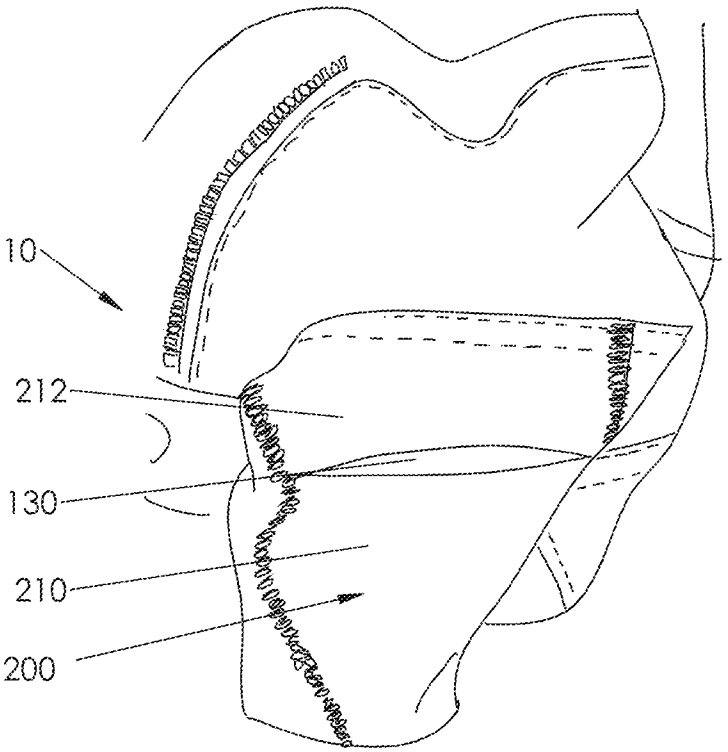
FIG. 4C is an alternative inside out view of the utility clip pocket shown in FIG. 4B.
Figure 4B:
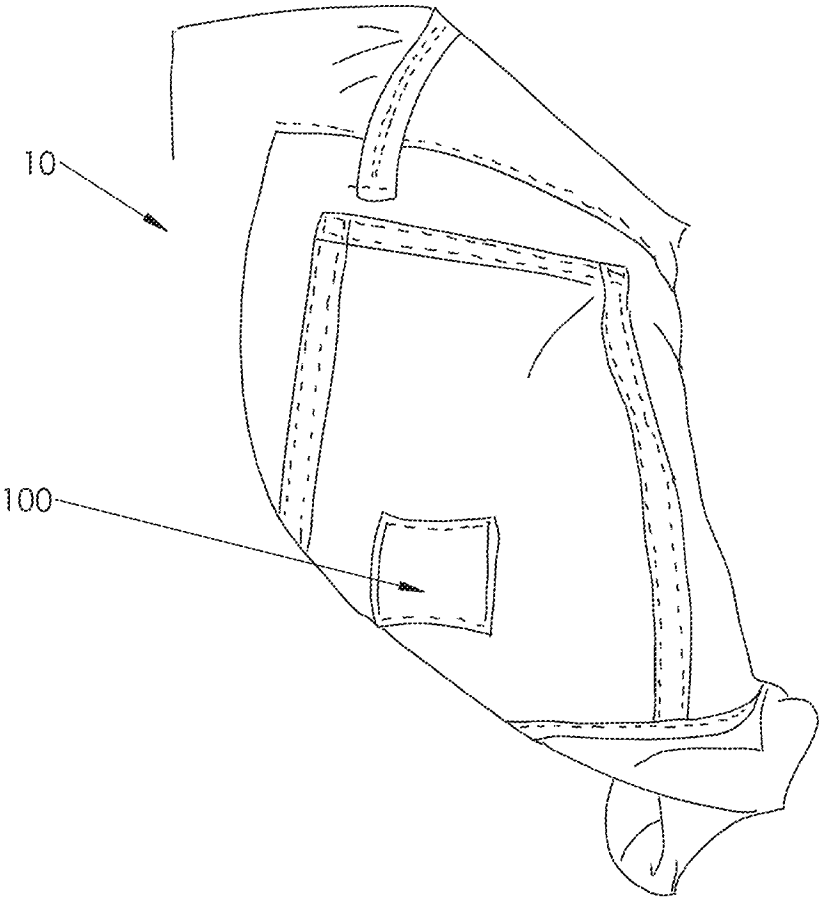
FIG. 4B is a view of the utility clip pocket inside out.

FIGS. 2 and 3 illustrate the loop 100 of FIG. 1 located within embodiments of the utility clip pocket 10. In FIG. 2, the loop 100 is secured to the garment layer 120 relatively closer to the user and is covered by an outer garment layer 130 relatively further from the user. The outer garment layer 130 may be a primary layer or the primary layer of the garment and may directly contact the user in areas other than the pocket 10. In some configurations, the loop 100 can be covered by additional layers of the garment, for example if the pocket 10 has a smaller inner pocket (i.e., secondary pocket 200, as described in FIG. 4A). In FIG. 3, the pocket 10 includes a coin pocket 140 formed by a coin pocket outside layer 142 secured to the garment layer 120. The loop 100 is secured to the outside layer 142 of the coin pocket 140. In some configurations, the loop 100 is equally spaced from a side 144 and a bottom 146 of the coin pocket, such as about five-eighths of an inch. In other embodiments, the loop 100 is spaced different amounts from the side 144 and the bottom 146 of the coin pocket 140. In some embodiments, the loop 100 may be spaced between 0.5 and 1 inch, 0.5 and 1.5, or 0.25 and 2 inches from the side 144 or the bottom 146 of the coin pocket 140. In alternative embodiments, the first connection 104 of the loop 100 may be located on the side 144 of the coin pocket 140, and as a result there may be no spacing.

In FIG. 2, the pocket 10 does not include a coin pocket 140 and the loop 100 is secured to a main layer 120 of the garment. The pocket 10 can include a first pocket side 12, a second pocket side 14, a bottom pocket side 16, and a top pocket of the pocket 18. The loop 100, and or the first side edge 102*a* of the material strap 102 or the second side edge 102*b* of the material strap 102, can be positioned at least ⅞ of an inch or at least 1 inch from the first pocket side 12, the second pocket side 14, the bottom pocket side 16, or the top pocket of the pocket 18. The loop 100, and/or the first side edge 102*a* of the material strap 102 or the second side edge 102*b* of the material strap 102, can be positioned between 1 and 4 inches, 0.5 and 3 inches, or 1 and 5 inches from the first pocket side 12, the second pocket side 14, the bottom pocket side 16, or the top pocket of the pocket 18. The loop 100 can be positioned in the same relative position in each pocket 10, as shown in FIG. 2 and FIG. 3, in a mirrored location between the right and left side pockets 10. The loops 100 may also be located in different positions in each pocket 10. However, it is not necessary to have loops 100 in each (or more than one) pocket 10 of a garment or other object incorporating the loop 100.

The loop 100 is secured within the pocket 10 at a location between an opening or top edge 110 of the pocket 10 and a closed or bottom end 112 of the pocket 10. In FIG. 2 and FIG. 3, the loop 100 is secured below a top edge 110 of the pocket 10 and above a bottom end 112 of the pocket 10. The loop 100 may be secured at least 0.5 inches below the top edge 110. In other embodiments, the loop 100 may be secured at least 1 inch, 1.5 inches, 2 inches, 2.5 inches, 3 inches, 3.5 inches, or 4 inches below the top edge 110. In some configurations, the loop 100 is positioned at about one-third of the depth or length of the pocket 10 or about two-thirds from the bottom or closed end 112 of the pocket 10. Such an arrangement provides for concealment of the item but allows for easy or convenient access. In the illustrated arrangement, the loop 100 is positioned closer to an outside edge or laterally outward edge of the pocket 10 than an inside edge or laterally inward edge of the pocket 10. In some configurations, the loop 100 is positioned within approximately an outermost one-quarter of the pocket 10.

In some configurations, the loop 100 is secured to the garment along its side edges 102*a*, 102*b*, such as an entirety of the side edges 102*a*, 102*b*, leaving the top and bottom edges 102*c*, 102*d* open to allow the item or a utility clip of the item to pass through the loop 100 between the loop 100 and the layer of the garment to which the loop 100 is secured. In some configurations, the loop 100 is square in shape and has dimensions of one inch by one inch. However, in other arrangements, the loop 100 could be rectangular having different dimensions in the height and width directions.

Figure 4E:
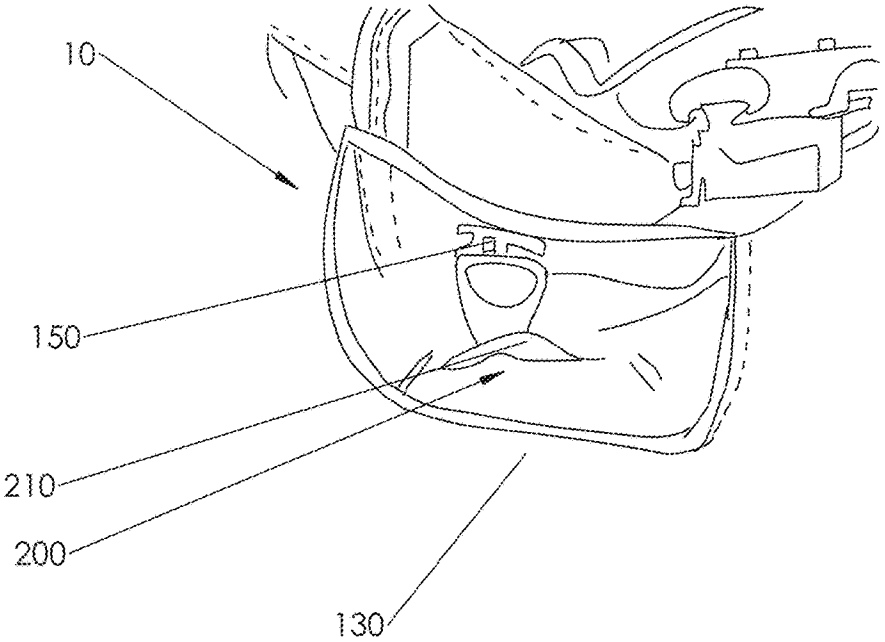
FIG. 4E is an alternative view of the utility clip pocket shown in FIG. 4D.
Figure 4D:
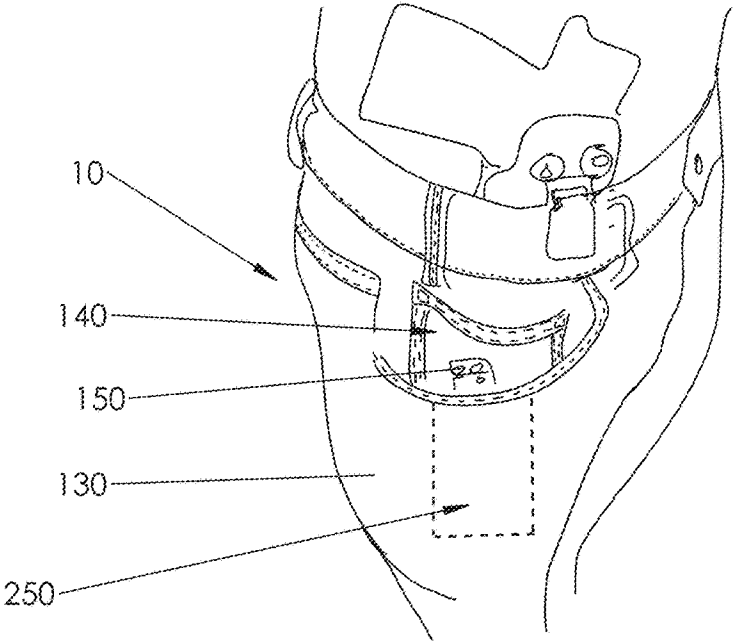
FIG. 4D is a view of the utility clip pocket with a secondary pocket.
Figure 4F:
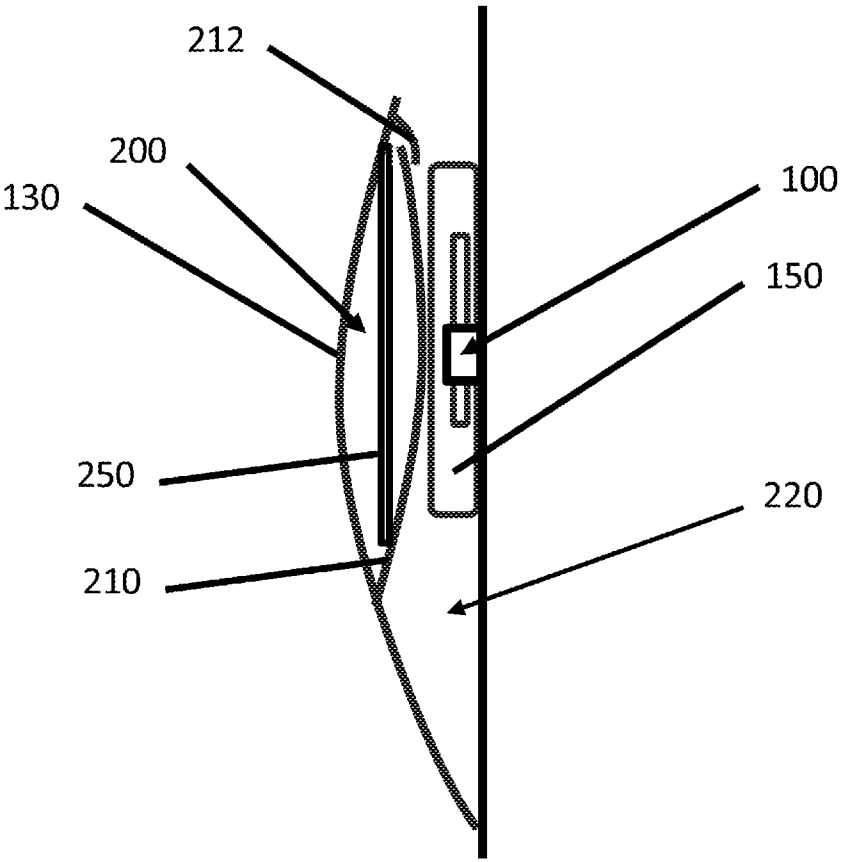
FIG. 4F is a sectional view of the utility clip pocket with a secondary pocket.

FIGS. 4A-4F illustrates an embodiment of the utility clip pocket 10 further comprising a secondary pocket 200. The secondary pocket 200 may be referred to as a passport pocket, a credit card pocket, or a sub pocket. In some embodiments, the secondary pocket 200 can include a secondary overlapping material 210 connected to the outer garment layer 130. The secondary overlapping material 210 may be connected on both sides and a bottom to form and define the secondary pocket 200. The secondary pocket 200 may also include a cover or lid 212. The lid 212 may also be referred to as a flap, a top, or a cap. The lid 212 may be an additional material piece that is connected to the outer garment layer 130 proximate to the top of secondary pocket 200, where the top of the secondary pocket 200 is the top of the secondary overlapping material 210. The secondary pocket 200 can be located so as to block, conceal or mask an item held in the loop 100 from view when full. As used herein, a "full" secondary pocket 200 means that an object is positioned within the secondary pocket 200 that is sized to at least partially cover the item (e.g., knife) held in the loop 100. A "full" secondary pocket 200 does not require that the entire spaced defined by the secondary pocket 200 be occupied by an object. As such the secondary pocket 200 may overlap the loop 100. The secondary pocket may be configured to hold an item 250 such as a passport, cellphone, or credit card. The item 250 stored in the secondary pocket 200 may block from at least from frontal view an item 150 held within an interior space 220 of the utility clip pocket 10 by the loop 100, such as a knife. FIG. 4D illustrates the concealing properties of the secondary pocket. The secondary pocket 200 has an item 250 located within the secondary pocket 200 and the loop 100 has a knife 150 secured to the loop 100. The secondary pocket 200 is adjacent to the loop 100 and, as such, the knife is hidden from a front viewers perspective. FIG. 4E shows the illustration of 4D from a top-down view into the utility pocket 10. A clip of the knife 150 is secured to the loop 100. FIG. 4F shows a cut away side view of an embodiment of the utility pocket clip 10 with a secondary pocket 200. The item 250 within the secondary pocket 200 blocks a user view of the item 150 secured by the loop 100. In the present embodiment the item 150 is a knife having a clip 152. The loop 100 secures the clip 152, holding the item 150 at a specific location within the pocket. The ability to hide the item 150 provides a distinct tactical and social advantage to a user.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A utility clip pocket, comprising:

an inner garment layer;

an outer garment layer connected to the inner garment layer and cooperating to form at least a portion of a pocket between the inner garment layer and the outer garment layer, the pocket defining an interior space; and a loop located within the interior space, the loop comprising a material strap having a top edge, a bottom edge, a first side having a first end, and a second side having a second end, the loop defining a single loop opening between the first end and the second end;

wherein the first side and the second side are secured at fixed locations, each with a stitched connection, within the interior space and the first end of the loop is spaced a first distance from a first side of the interior space, the second end of the loop is spaced a second distance from a top of the interior space, and a bottom edge of the loop is spaced a third distance from a bottom of the interior space;

wherein the inner garment layer and the outer garment layer form a portion of a lower body garment.

2. The utility clip pocket of claim 1, wherein the first distance and the second distance are between 1 and 4 inches.

3. The utility clip pocket of claim 1, wherein the first distance and the second distance is at least 1 inch.

4. The utility clip pocket of claim 1, wherein a distance between the first side and the second side of the material strap is less than a distance from the first side of the interior space to a second side of the interior space.

5. The utility clip pocket of claim 1, wherein the loop is configured to engage a clip of a knife.

6. The utility clip pocket of claim 1, wherein the material strap is between 0.5 and 2 inches wide.

7. The utility clip pocket of claim 1, further comprising a coin pocket located within the interior space.

8. The utility clip pocket of claim 7, wherein the first side and the second side of the material strap are secured to the coin pocket.

9. The utility clip pocket of claim 1, further comprising a secondary overlapping material located within the interior space and overlapping the loop, the secondary overlapping material connected to the outer garment layer, wherein the secondary overlapping material cooperates with the outer garment layer to form a secondary pocket within the interior space, the secondary pocket comprising a flap located between the inner garment layer and the outer garment layer.

10. The utility clip pocket of claim 9, wherein the secondary pocket is positioned adjacent to the loop and configured to hide an object within the loop when the secondary pocket is full.

11. The utility clip pocket of claim 9, wherein a lowermost extent of the secondary overlapping material is spaced above the bottom of the interior space.

12. The utility clip pocket of claim 1, wherein the loop is spaced a fourth distance from a second side of the pocket.

13. The utility clip pocket of claim 1, wherein each of the fixed connections is formed by a stitched connection.

14. A lower body garment comprising:

a pair of pants or shorts;

a utility clip pocket attached to the pair of pants or shorts, the utility clip pocket comprising:

an outer garment layer;

an inner garment layer having a first side, a second side, and a bottom side;

a first side connection wherein the first side is connected to outer garment layer;

a second side connection wherein the second side is connected to the outer garment layer;

a bottom side connection wherein the bottom side is connected to the outer garment layer;

wherein the outer garment layer, the inner garment layer, the first side connection, the second side connection, and the bottom side connection cooperate to form at least a portion of a pocket between the outer garment layer and the inner garment layer interior of the first side connection, the second side connection, and the bottom connection, the pocket defining an interior space; and a loop located within the interior space, the loop comprising a material strap having a top edge, a bottom edge, a first strap side having a first end, and a second strap side having a second end, the loop defining a single loop opening between the first end and the second end, wherein a width of the loop between the first end and the second end is between 5 percent and 25 percent of a width of the interior space of the pocket;

wherein the first strap side and the second strap side are secured to the garment with the first end closer to the first side connection than the second end and the second end closer to the second side connection than the first side connection such that the material strap extends in a width direction of the pocket; and wherein the loop is spaced a first distance from a first side of the interior space, a second distance from a top of the interior space, and a third distance from a bottom side of the interior space, wherein the first distance and the second distance are selected to position the loop within a laterally outermost one-quarter of the interior space of the pocket.

15. The garment of claim 14, wherein a distance between the first strap side and the second strap side is less than a distance from the first side connection to the second side connection.

16. The garment of claim 14, wherein the loop is configured to engage a clip of a knife.

17. The garment of claim 14, wherein the material strap is between 0.5 and 2 inches wide.

18. The garment of claim 14, further comprising a coin pocket located within the interior space.

19. The garment of claim 18, wherein the first distance and the second distance are between 1 and 4 inches.

20. The garment of claim 14, wherein the first distance and the second distance is at least 1 inch.

21. The garment of claim 14, further comprising a secondary overlapping material located within the interior space and overlapping the loop, the secondary overlapping material connected to the inner garment layer, wherein the secondary overlapping material cooperates with the inner garment layer to form a secondary pocket.

22. The garment of claim 21, wherein the secondary pocket is positioned adjacent to the loop and configured to hide an item within the loop when the secondary pocket is full.

23. The garment of claim 14, wherein each of the first strap side and the second strap side are secured to the garment at a fixed location with a fixed connection.

24. The garment of claim 14, wherein the first side connection, the second side connection and the bottom connection are fixed.

* * * * *